US006992690B2

(12) United States Patent
Mogi et al.

(10) Patent No.: US 6,992,690 B2
(45) Date of Patent: Jan. 31, 2006

(54) MULTI-BEAM SCANNING APPARATUS

(75) Inventors: Shin Mogi, Kashiwa (JP); Yasutaka Naruge, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/392,626

(22) Filed: Sep. 9, 1999

(65) Prior Publication Data

US 2002/0012041 A1 Jan. 31, 2002

(30) Foreign Application Priority Data

Sep. 14, 1998 (JP) ..... 10-279352
Nov. 30, 1998 (JP) ..... 10-355353

(51) Int. Cl.
*B41J 2/45* (2006.01)

(52) U.S. Cl. ..... 347/238

(58) Field of Classification Search ..... 347/238, 347/241–242, 256–257, 237, 245, 247, 263; 359/641, 819, 821, 822, 826; 372/107
See application file for complete search history.

(56) References Cited

U.S. PATENT DOCUMENTS 4,800,401 A * 1/1989 Sato et al. ..... 347/242
4,993,801 A * 2/1991 Sarraf ..... 359/641
5,408,493 A * 4/1995 Aoki ..... 372/107
5,774,248 A 6/1998 Komatsu ..... 359/204
5,786,594 A 7/1998 Ito et al. ..... 250/236
5,999,345 A * 12/1999 Nakajima et al. ..... 359/821

FOREIGN PATENT DOCUMENTS

| | | | |
|---|---|---|---|
| EP | 0 804 015 | | 10/1997 |
| JP | 06-242160 | | 9/1994 |
| JP | 9-243944 | * | 9/1997 |
| JP | 09329754 A | * | 12/1997 |
| JP | 10-10447 | * | 1/1998 |
| JP | 10-244707 | * | 9/1998 |

* cited by examiner

*Primary Examiner*—Hai Pham
(74) *Attorney, Agent, or Firm*—Fitzpatrick, Cella, Harper & Scinto

(57) ABSTRACT

A multi-beam scanning apparatus has a multi-beam semiconductor laser which emits a plurality of laser beams, a laser holder holding the multi-beam semiconductor laser, a multi-beam light source unit having the multi-beam semiconductor laser and the laser holder, scanning imaging unit for scanning a plurality of laser beams emitted by the multi-beam semiconductor laser to form an image on a surface to be scanned, and a housing supporting the scanning imaging unit and the multi-beam light source unit. The multi-beam semiconductor laser is fixed to the laser holder with an inclination at or near a predetermined rotational angle for adjusting a beam interval between the plurality of laser beams.

7 Claims, 9 Drawing Sheets

MULTI-BEAM SCANNING APPARATUS

BACKGROUND OF THE INVENTION

1. Field of the Invention

The present invention relates to a multi-beam scanning apparatus used for a laser beam printer, digital copying machine, and the like.

2. Related Background Art

In recent years, multi-beam scanning apparatuses for simultaneously writing a plurality of lines using a plurality of laser beams are being developed in electrophotographic apparatuses such as a laser beam printer.

The multi-beam scanning apparatus simultaneously scans a plurality of laser beams apart from each other. As shown in FIG. 1, in the multi-beam scanning apparatus, a multi-beam semiconductor laser 111 serving as a light source for a multi-beam light source unit 101 emits two laser beams $P_1$ and $P_2$. The laser beams $P_1$ and $P_2$ are collimated by a collimator lens 112, irradiate a reflecting surface 103*a* of a rotary polygon mirror 103 via a cylindrical lens 102, and form an image on a photosensitive member on a rotary drum 105 via an imaging lens 104.

The two laser beams $P_1$ and $P_2$ are incident on the reflecting surface 103*a* of the rotary polygon mirror 103, scanned in the main scanning direction, and form an electrostatic latent image on the photosensitive member along with main scanning by rotation of the rotary polygon mirror 103 and subscanning by rotation of the rotary drum 105.

The cylindrical lens 102 linearly focuses the laser beams $P_1$ and $P_2$ on the reflecting surface 103*a* of the rotary polygon mirror 103. The cylindrical lens 102 has a function of preventing a point image formed on the photosensitive member in the above manner from being distorted due to surface tilt of the rotary polygon mirror 103. The imaging lens 104 is made up of a spherical lens and toric lens. The imaging lens 104 has a function of preventing distortion of a point image on the photosensitive member, similar to the cylindrical lens 102, and a correction function of scanning the point image on the photosensitive member in the main scanning direction at a constant speed.

The two laser beams $P_1$ and $P_2$ are respectively split by a detection mirror 106 at the end of the main scanning plane (X-Y plane), guided to a photosensor 107 on an opposite side to the main scanning plane, and converted into write start signals in a controller (not shown) to be transmitted to the multi-beam semiconductor laser 111. The multi-beam semiconductor laser 111 receives the write start signals to start write modulation of the two laser beams $P_1$ and $P_2$.

By adjusting the write modulation timings of the two laser beams $P_1$ and $P_2$, the write start (write) position of an electrostatic latent image formed on the photosensitive member on the rotary drum 105 is controlled.

The cylindrical lens 102, rotary polygon mirror 103, imaging lens 104, and the like are mounted on the bottom wall of an optical box 108. After the respective optical components are mounted in the optical box 108, the upper opening of the optical box 108 is closed with a lid (not shown).

As described above, the multi-beam semiconductor laser 111 simultaneously emits the laser beams $P_1$ and $P_2$. The multi-beam semiconductor laser 111 is integrated via a laser holder 111*a* with a lens barrel 112*a* incorporating the collimator lens 112, and the integral unit is mounted on a sidewall 108*a* of the optical box 108 together with a laser driving circuit board 113.

In mounting the multi-beam light source unit 101, the laser holder 111*a* holding the multi-beam semiconductor laser 111 is inserted into an opening 108*b* formed in the sidewall 108*a* of the optical box 108. The laser holder 111*a* is fitted in the lens barrel 112*a* of the collimator lens 112, the focal point and optical axis of the collimator lens 112 are adjusted, and the lens barrel 112*a* is adhered to the laser holder 111*a*. As shown in FIG. 2A, the laser holder 111*a* is rotated through a predetermined angle θ to adjust a straight line connecting the emission points of the laser beams $P_1$ and $P_2$, i.e., the inclination angle of a laser array N. More specifically, as shown in FIG. 2B, the beam interval between the laser beams $P_1$ and $P_2$ emitted by the multi-beam semiconductor laser 111 is adjusted to make a pitch S between imaging points $A_1$ and $A_2$ on the rotary drum 105 in the main scanning direction, and a pitch, i.e., line interval T in the subscanning direction coincide with design values. After this adjustment, the laser holder 111*a* is fixed to the sidewall 108*a* of the optical box 108 with a screw or the like.

In the prior art, however, when the multi-beam light source unit is to be fixed to the optical box, the whole multi-beam light source unit is rotated through the predetermined angle θ together with the laser driving circuit board, thereby obtaining the line interval T. To realize this, a space enough to rotate the large-area laser driving circuit board must be prepared outside the optical box, which interferes with downsizing of the whole apparatus.

Further, an error allowable value for adjustment of the line interval T is as strict as several μm or less. If the angular adjustment range in assembling the multi-beam light source unit to the optical box is wide, high-precision adjustment is difficult to complete within a short time. The multi-beam light source unit cannot be assembled with high working efficiency and high reliability.

SUMMARY OF THE INVENTION

The present invention has been made to eliminate the conventional drawbacks, and has as its object to provide a multi-beam scanning apparatus which can be downsized and allows adjusting of the beam interval within a short time with high precision.

To achieve the above object, according to the present invention, there is provided a multi-beam scanning apparatus comprising a multi-beam light source unit having a multi-beam semiconductor laser and a laser holder holding the multi-beam semiconductor laser, scanning imaging means for scanning a plurality of laser beams emitted by the multi-beam semiconductor laser to form an image on a surface to be scanned, and a housing supporting the scanning imaging means and the multi-beam light source unit. The multi-beam semiconductor laser is fixed to the laser holder with an inclination at or near a predetermined rotational angle for adjusting a beam interval between the plurality of laser beams.

In the multi-beam scanning apparatus, the multi-beam semiconductor laser preferably has a laser array fixed with an inclination with respect to a reference surface of the laser holder.

The multi-beam semiconductor laser preferably has a plurality of aligned emission points.

The multi-beam semiconductor laser preferably has a plurality of two-dimensionally arrayed emission points.

The laser holder is preferably integrated with a lens barrel holding a collimator lens.

In mounting the laser holder in the housing after the multi-beam semiconductor laser is fixed to the laser holder, the whole multi-beam light source unit is inclined (rotated) to adjust the beam interval. In this arrangement, however, angular adjustment is difficult to perform precisely, and takes a long time. In addition, an extra space is required to incline the large-area laser driving circuit board mounted on the multi-beam light source unit. To avoid this, in a unit assembly step of assembling the multi-beam semiconductor laser to the laser holder, the multi-beam semiconductor laser is rotated (inclined) through an angle necessary for adjusting the beam interval or an angle approximate to the necessary angle. In this state, the multi-beam semiconductor laser is fixed to the laser holder into a unit.

In mounting the multi-beam light source unit in the housing, the whole multi-beam light source unit is rotated through a small angle in order to finally adjust a small error arising from the component precision and the like.

Since final angular adjustment in mounting the multi-beam light source unit in the housing is done within a small angular range, the angle can be quickly adjusted with high precision.

Since the large-area laser driving circuit board need not be greatly inclined, the whole apparatus can be downsized.

The present invention has been made to eliminate the conventional drawbacks, and has as its object to provide a low-cost, high-performance multi-beam scanning apparatus which can easily ensure the installation positional precision of the multi-beam light source unit in terms of the structure, can improve the adjustment precision of the multi-beam line interval, can efficiently mount the multi-beam light source unit, and can maintain high image quality without generating any error upon mounting.

To achieve the above object, according to the present invention, there is provided a multi-beam scanning apparatus comprising a multi-beam light source unit having a multi-beam semiconductor laser and a laser holder holding the multi-beam semiconductor, scanning imaging means for scanning a plurality of laser beams emitted by the multi-beam semiconductor laser to form an image on a surface to be scanned, a housing supporting the scanning imaging means and the multi-beam light source unit, and fixing means for fixing the multi-beam light source unit to the housing after the rotational angle of the multi-beam light source unit is adjusted, the fixing means having a plurality of fixing portions. The center of the rotation of the multi-beam light source unit and a plurality of emission points of the multi-beam semiconductor laser are located on a straight line connecting two of the plurality of fixing portions or a planar region defined by straight lines connecting all the plurality of fixing portions.

The fixing means preferably has at least three fixing portions.

The fixing means preferably has a fixing portion fastened by a screw.

The fixing means preferably has a fixing portion adhered with an adhesive.

The multi-beam semiconductor laser preferably has a plurality of aligned emission points.

The multi-beam semiconductor laser preferably has a plurality of two-dimensionally arrayed emission points.

The laser holder is preferably integrated with a lens barrel holding a collimator lens.

In mounting the multi-beam semiconductor laser in the housing, the whole multi-beam light source unit is rotated to adjust the line interval. Thereafter, screws or the like are tightened to fix the multi-beam light source unit to the housing.

A plurality of fixing portions by screws or the like are set. The emission points of laser beams and the center of rotation of the multi-beam light source unit are located on a straight line connecting two of the fixing portions or a planar region defined by straight lines connecting all the fixing portions. Accordingly, the multi-beam light source unit can be very firmly, stably fixed to the housing.

Hence, no rotational shift occurs in the multi-beam light source unit due to shock or the like after the multi-beam light source unit is fixed to the housing.

Trouble such as a shift of the rotational angle of the multi-beam light source unit due to free running during screw tightening operation does not occur. Thus, the assembly efficiency and precision can be improved.

BRIEF DESCRIPTION OF THE DRAWINGS

FIGS. 11A and 11B are views showing the fourth embodiment of the multi-beam light source unit, in which FIG. 11A is a plan view showing the layout of three fixing portions, and FIG. 11B is a sectional view showing the fixing portions.

DETAILED DESCRIPTION OF THE PREFERRED EMBODIMENTS

Embodiments of the present invention will be described below with reference to the accompanying drawings.

Figure 1:
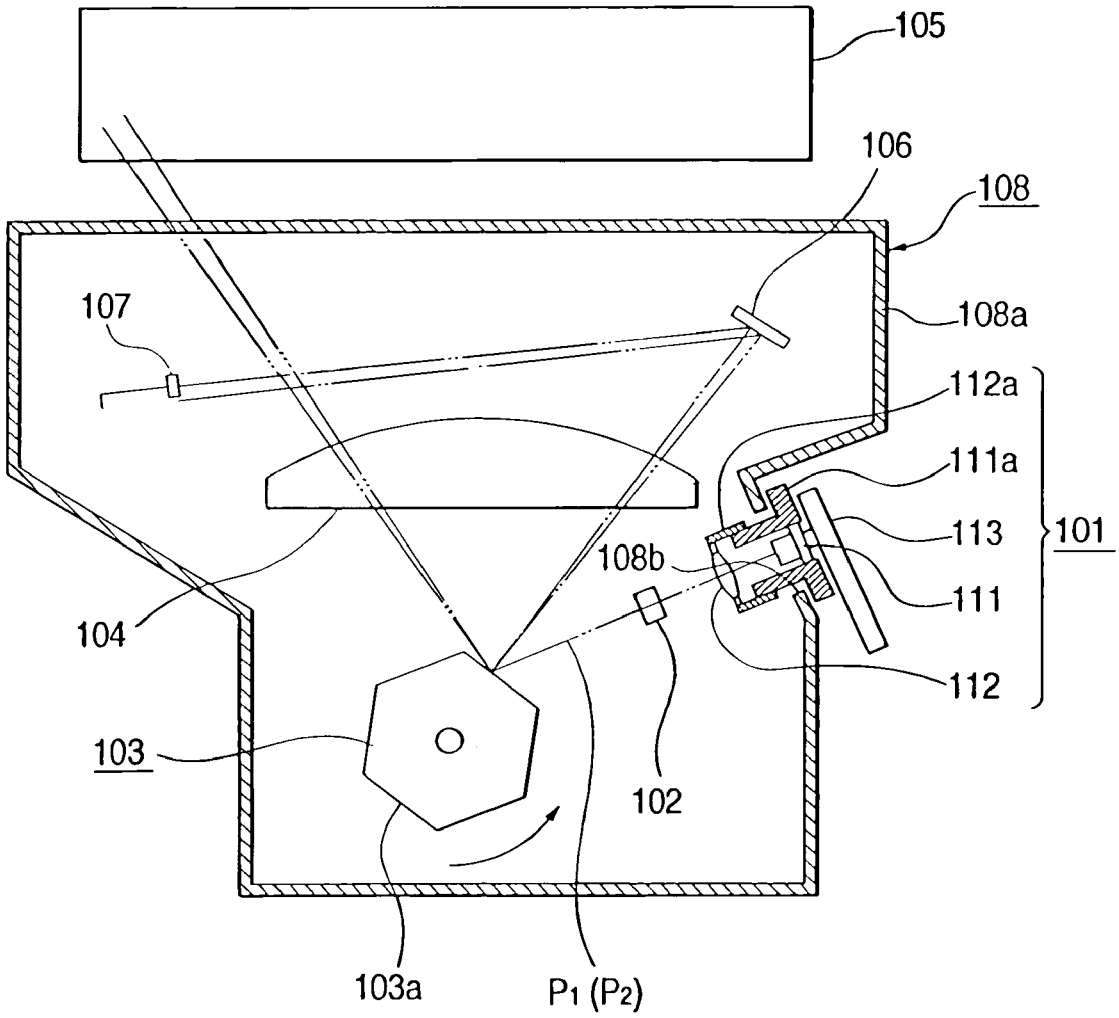
FIG. 1 PRIOR ART
FIG. 1 is a schematic plan view showing a conventional multi-beam scanning apparatus.
Figure 2A:
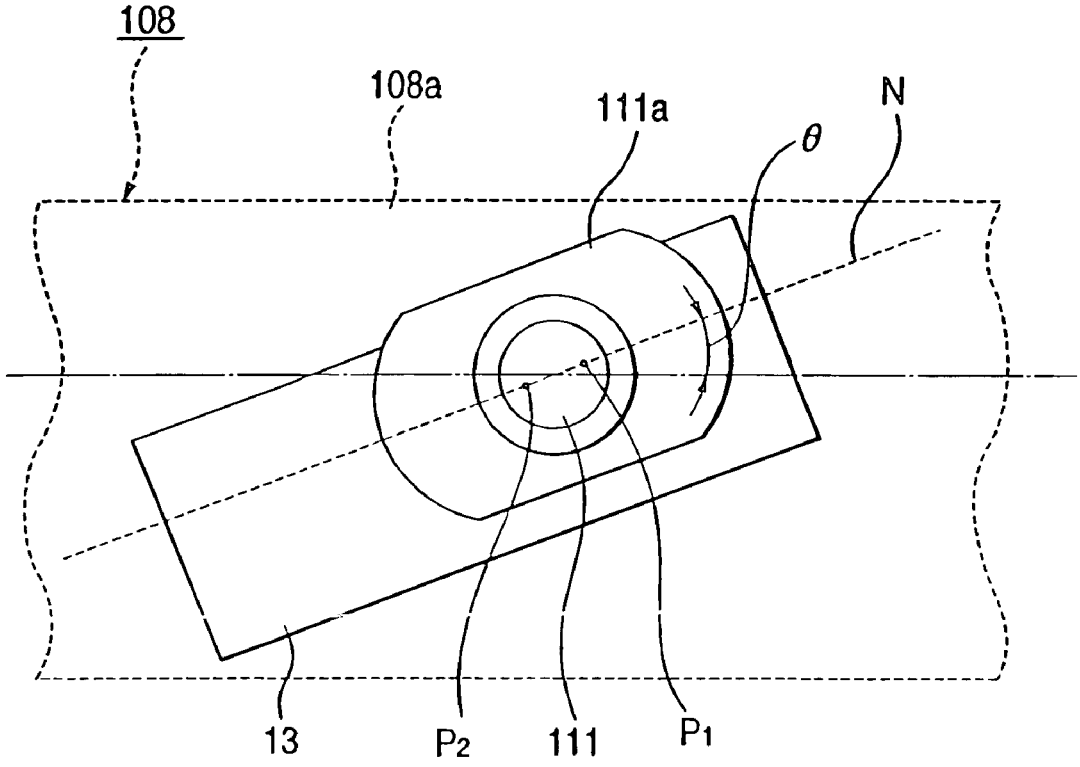
FIG. 2A PRIOR ART
FIGS. 2A and 2B are views for explaining line interval adjustment in the multi-beam scanning apparatus in FIG. 1.
Figure 2B:
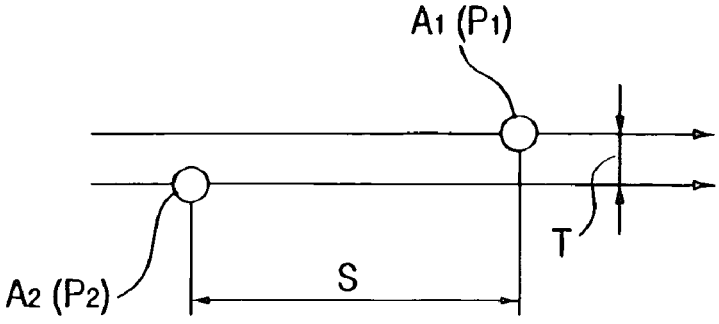
FIG. 2B PRIOR ART
Figure 3:
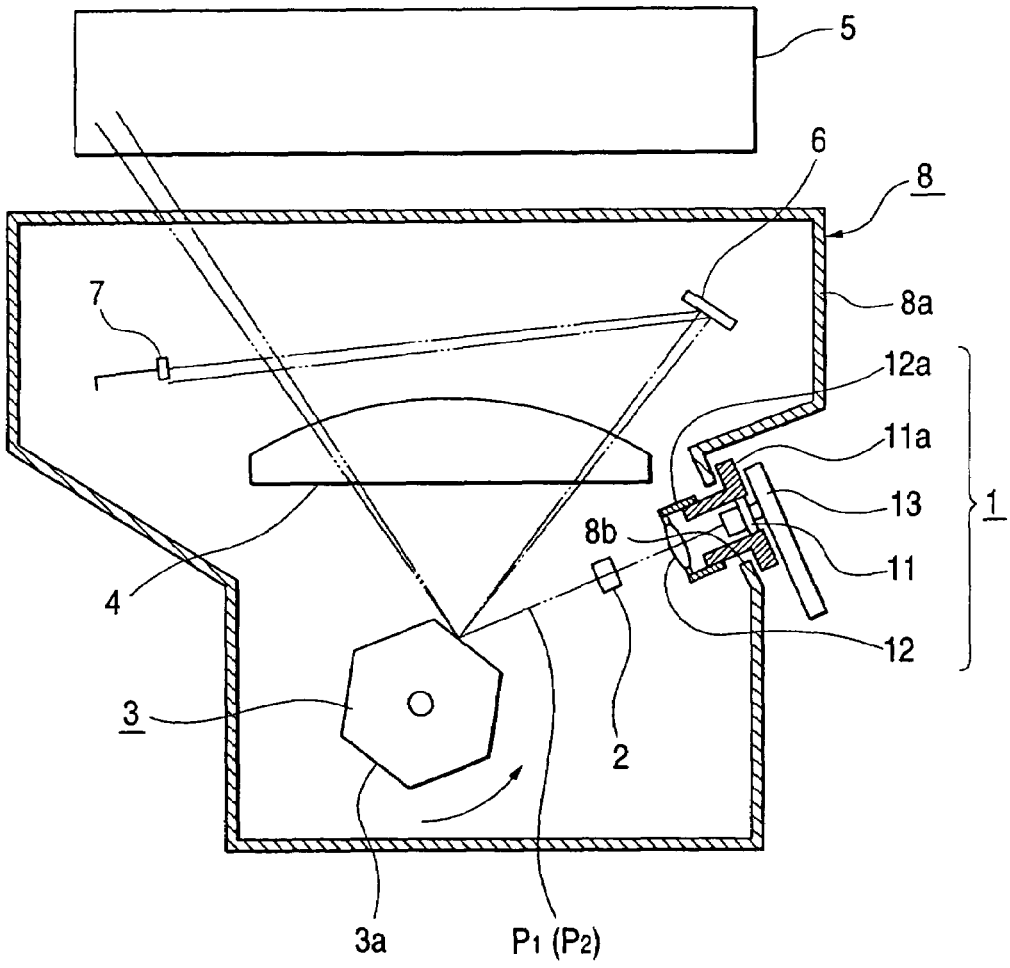
FIG. 3 is a schematic plan view showing a multi-beam scanning apparatus according to the present invention.

FIG. 3 shows a multi-beam scanning apparatus according to the present invention. In this multi-beam scanning apparatus, a multi-beam semiconductor laser 11 serving as a light source for a multi-beam light source unit 1 emits two laser beams $P_1$ and $P_2$. The laser beams $P_1$ and $P_2$ are collimated by a collimator lens 12, irradiate a reflecting surface 3*a* of a rotary polygon mirror 3 via a cylindrical lens 2, and form an image on a photosensitive member on a rotary drum 5 serving as a surface to be scanned via an imaging lens 4 which constitutes a scanning imaging means together with the rotary polygon mirror 3.

The two laser beams $P_1$ and $P_2$ are incident on the reflecting surface 3*a* of the rotary polygon mirror 3, scanned in the main scanning direction, and form an electrostatic latent image on the photosensitive member along with main scanning by rotation of the rotary polygon mirror 3 and subscanning by rotation of the rotary drum 5.

The cylindrical lens 2 linearly focuses the laser beams $P_1$ and $P_2$ on the reflecting surface 3*a* of the rotary polygon mirror 3. The cylindrical lens 2 has a function of preventing a point image formed on the photosensitive member in the above manner from being distorted due to surface tilt of the rotary polygon mirror 3. The imaging lens 4 is made up of a spherical lens and toric lens. The imaging lens 4 has a function of preventing distortion of a point image on the photosensitive member, similar to the cylindrical lens 2, and a correction function of scanning the point image on the photosensitive member in the main scanning direction at a constant speed.

The two laser beams $P_1$ and $P_2$ are respectively split by a detection mirror 6 at the end of the main scanning plane (X-Y plane), guided to a photosensor 7 on an opposite side to the main scanning plane, and converted into write start signals in a controller (not shown) to be transmitted to the multi-beam semiconductor laser 11. The multi-beam semiconductor laser 11 receives the write start signals to start write modulation of the two laser beams $P_1$ and $P_2$.

By adjusting the write modulation timings of the two laser beams $P_1$ and $P_2$, the write start (write) position of an electrostatic latent image formed on the photosensitive member on the rotary drum 5 is controlled.

The cylindrical lens 2, rotary polygon mirror 3, imaging lens 4, and the like are mounted on the bottom wall of an optical box 8 serving as a housing. After the respective optical components are mounted in the optical box 8, the upper opening of the optical box 8 is closed with a lid (not shown).

As described above, the multi-beam semiconductor laser 11 simultaneously emits the laser beams $P_1$ and $P_2$. The multi-beam semiconductor laser 11 is integrated via a laser holder 11*a* with a lens barrel 12*a* incorporating the collimator lens 12, and the integral unit is mounted on a sidewall 8*a* of the optical box 8 together with a laser driving circuit board 13.

In mounting the multi-beam light source unit 1, the laser holder 11*a* holding the multi-beam semiconductor laser 11 is inserted into an opening 8*b* formed in the sidewall 8*a* of the optical box 8. The laser holder 11*a* is fitted in the lens barrel 12*a* of the collimator lens 12, three-dimensional adjustment such as focus adjustment and optical axis adjustment of the collimator lens 12 is done, and the lens barrel 12*a* is adhered to the laser holder 11*a*.

Figure 4:
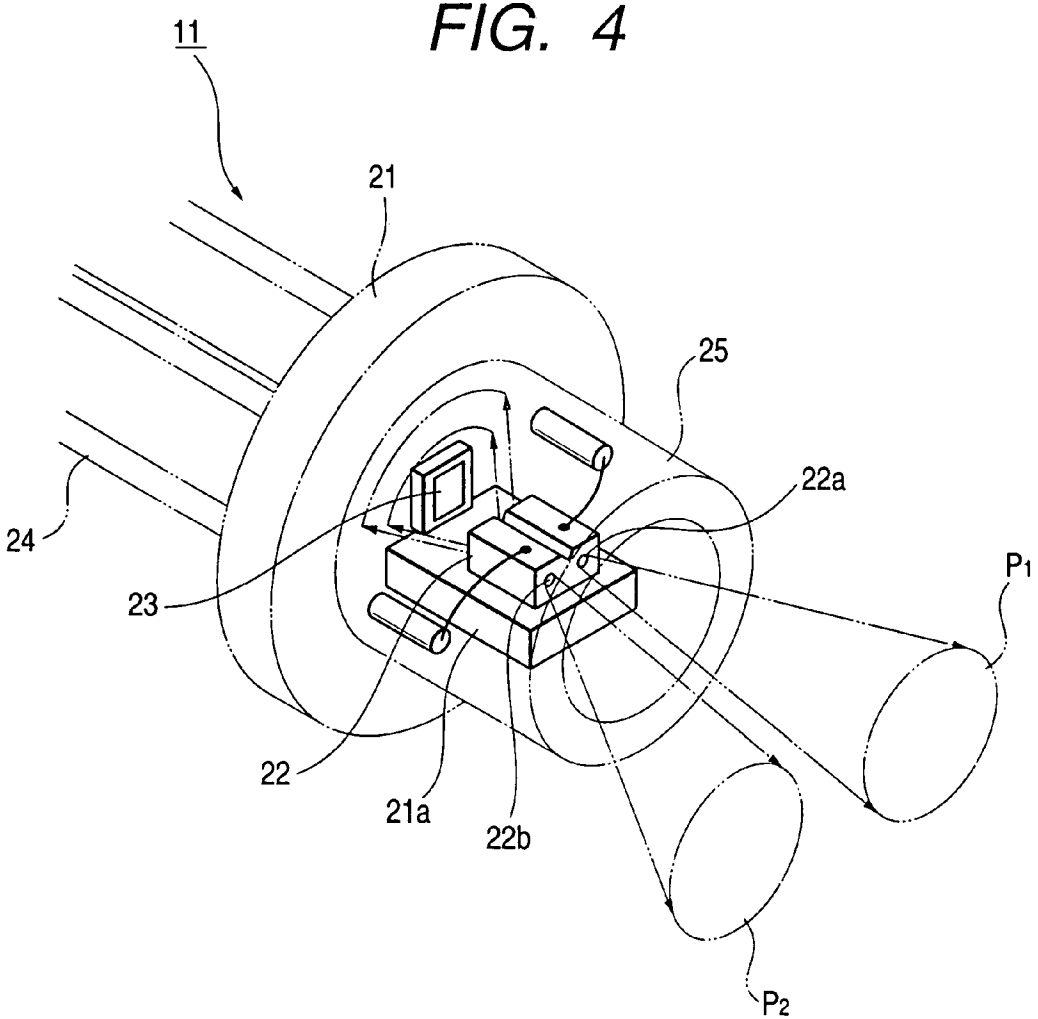
FIG. 4 is an enlarged perspective view showing the first embodiment of a multi-beam light source unit in the multi-beam semiconductor laser of the apparatus in FIG. 3.

As shown in FIG. 4, the multi-beam semiconductor laser 11 comprises a laser chip 22 fixed to a pedestal 21*a* integrated with a stem 21, a photodiode 23 for monitoring the emission amounts of laser beams $P_1$ and $P_2$ emitted from two emission points 22*a* and 22*b* on the laser chip 22, and an enerigization terminal 24 for energizing the laser chip 22 and the like. The laser chip 22 and the like are covered with a cap 25.

Figure 5A:
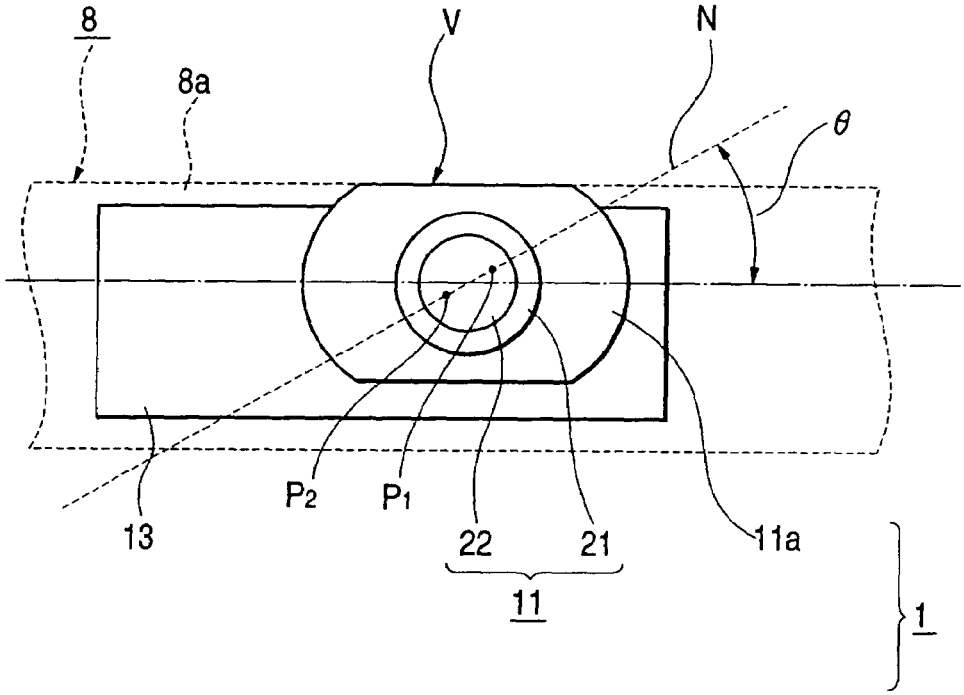
FIGS. 5A and 5B are views for explaining line interval adjustment.
Figure 5B:
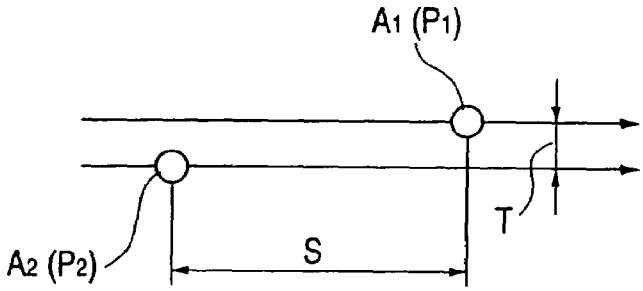

In a unit assembly step of mounting the multi-beam semiconductor laser 11 in the laser holder 11*a*, the multi-beam semiconductor laser 11 is rotated through a predetermined rotational angle θ or angle approximate to the angle θ with respect to a reference surface V of the laser holder 11*a*, as shown in FIG. 5A, thereby adjusting in advance the inclination angle of a straight line, i.e., laser array N connecting the emission points of the laser beams $P_1$ and $P_2$. More specifically, the beam interval between the laser beams $P_1$ and $P_2$ emitted by the multi-beam semiconductor laser 11 is adjusted to make a pitch S between imaging points $A_1$ and $A_2$ on the rotary drum 5 in the main scanning direction, and a pitch, i.e., line interval T in the subscanning direction coincide with design values in advance (see FIG. 5B). After this adjustment, the multi-beam semiconductor laser 11 is fixed to the laser holder 11*a* to obtain a unit.

Figure 6:
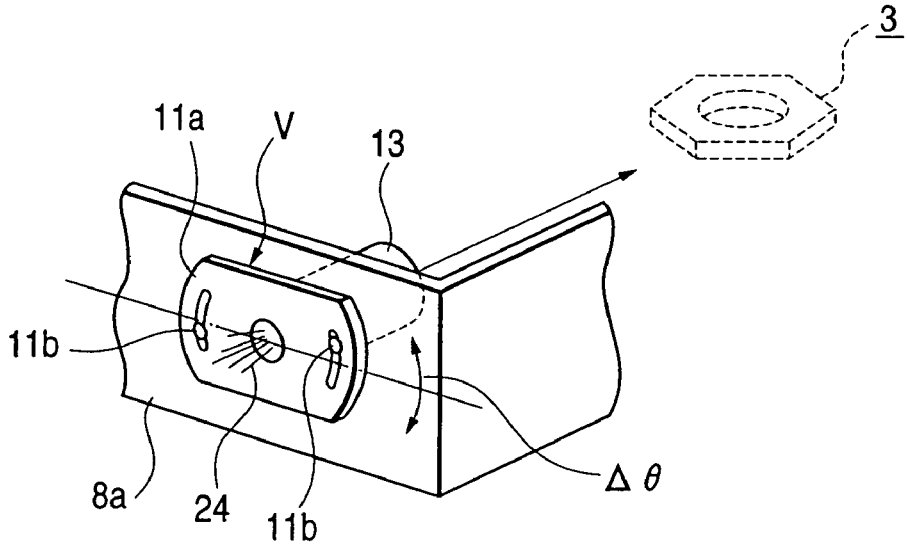
FIG. 6 is a perspective view showing a laser holder temporarily fixed to an optical box.
Figure 7:
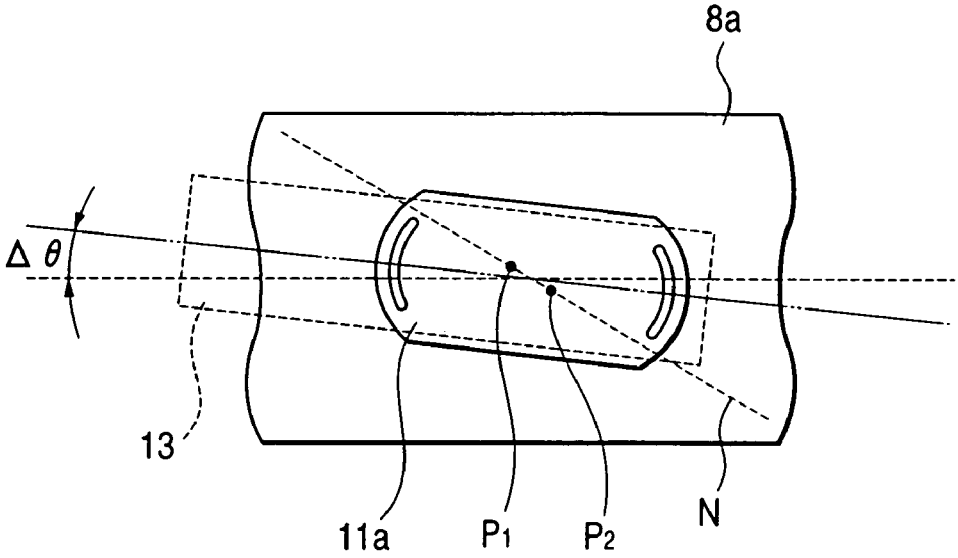
FIG. 7 is a view for explaining final line interval adjustment.

After the lens barrel 12*a* of the collimator lens 12 is adhered to the laser holder 11*a*, as described above, the laser holder 11*a* is temporarily fixed to the sidewall 8*a* of the optical box 8 with screws 11*b* fitted in slots of the laser holder 11*a*, as shown in FIG. 6. While emitting the laser beams $P_1$ and $P_2$, the laser holder 11*a* is rotated through a small angle Δθ for final adjustment of the line interval T in order to compensate for the precision of each apparatus component and an error at the fit portion of the multi-beam semiconductor laser 11 itself. In practice, as indicated by the broken line in FIG. 7, this adjustment is done after the laser driving circuit board 13 is mounted on the laser holder 11*a*. Upon the final adjustment, the screws 11*b* are tightened to fix the laser holder 11*a* to the optical box 8.

The line interval T on the rotary drum must be adjusted with submicron-order precision. In the first embodiment, when the multi-beam semiconductor laser is mounted in the laser holder, the laser array N is roughly adjusted to or near to the predetermined inclination angle θ. When the laser holder is mounted in the optical box together with the laser driving circuit board, the angle is finally slightly adjusted to correct an assembly error and the like. Therefore, the final line interval adjustment precision is very high, and the adjustment time can be greatly shortened compared to the conventional wide-range angular adjustment on the optical box. In addition, the large-area laser driving circuit board need not be rotated outside the optical box, and the apparatus can be downsized.

As a result, this embodiment can realize a small-size, high-precision multi-beam scanning apparatus with low assembly cost.

Note that this embodiment uses the laser chip with two emission points. However, the number of emission points, i.e., laser beams can be arbitrarily changed. The assembly procedure of the laser driving circuit board, lens barrel, collimator lens, and the like can also be arbitrarily changed. The laser holder can be fixed to the optical box not only with a fastening means such as a screw, but also by another method such as adhesion.

Figure 8:
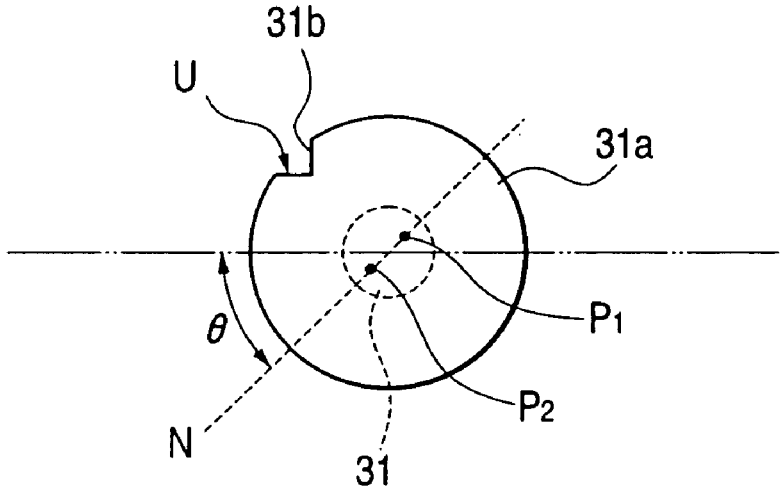
FIG. 8 is a schematic view showing the second embodiment of the multi-beam light source unit.

FIG. 8 shows the second embodiment of the multi-beam light source unit. This multi-beam light source unit uses a disk-like laser holder 31*a* instead of the rectangular laser holder 11*a* having a reference surface V as an end face. In this case, a reference surface U with a rotational angle θ in mounting a multi-beam semiconductor laser 31 in the laser holder 31*a* is defined at a notched portion 31*b* at the circumferential portion of the laser holder 31*a*.

Figure 9:
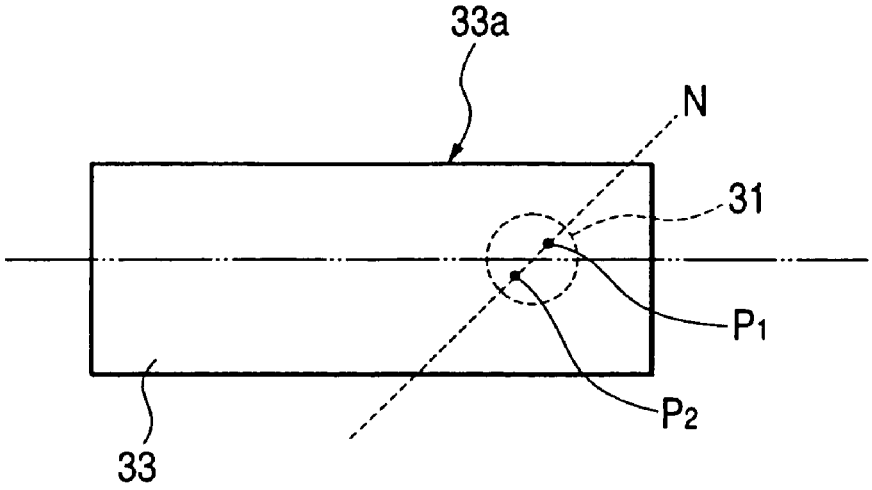
FIG. 9 is a schematic view showing a multi-beam semiconductor laser in FIG. 8 together with a laser driving circuit board.

As shown in FIG. 9, a laser driving circuit board 33 is mounted on the laser holder 31*a* such that an upper end face 33*a* serves as an attachment reference for an optical box (not shown).

Figure 10:
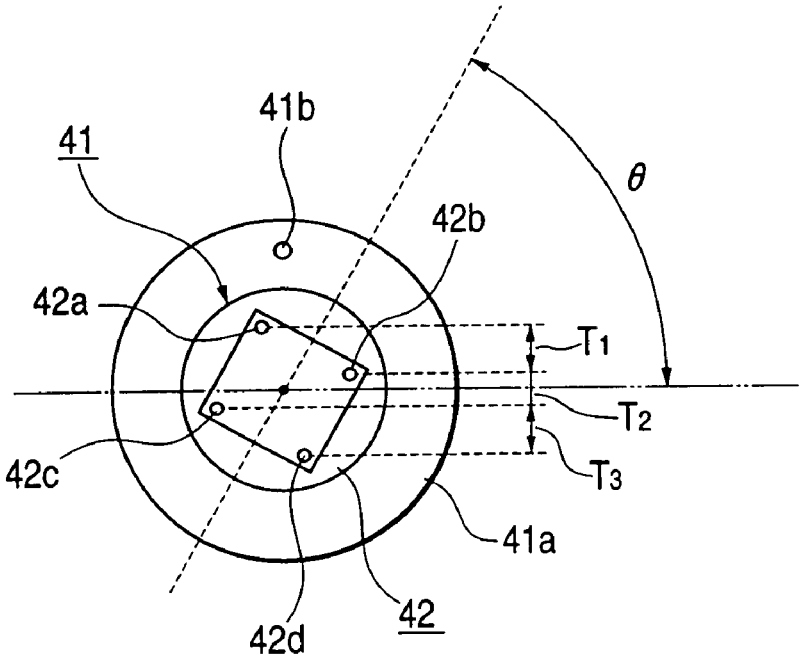
FIG. 10 is a schematic view showing the third embodiment of the multi-beam light source unit.

The edge-emission-type multi-beam semiconductor lasers 11 and 31 on each of which a plurality of emission points are aligned may be replaced with a multi-beam semiconductor laser 41 having a surface-emission-type laser chip 42 on which a plurality of emission points 42*a* to 42*d* are two-dimensionally arrayed, as shown in FIG. 10. This multi-beam semiconductor laser 41 can advantageously reduce optical aberration because all the emission points can be made close to the optical axis of the collimator lens. A positioning hole 41*b* is formed in a disk-like laser holder 41*a* as a positioning reference used to adjust the rotational angle θ for adjusting beam intervals $T_1$ to $T_3$.

The surface-emission-type laser can increase the degree of freedom for the positions of the emission points to facilitate distribution of the mounting tolerance.

As described above, in the multi-beam scanning apparatus of the present invention, the two laser beams $P_1$ and $P_2$ emitted by the multi-beam semiconductor laser 11 are scanned by the rotary polygon mirror inside the optical box 8, and form an image on the photosensitive member on the rotary drum via the imaging lens. To adjust the line interval T and the like on the photosensitive member, when the multi-beam semiconductor laser 11 is to be mounted in the laser holder 11*a*, the multi-beam semiconductor laser 11 is rotated to incline the laser array N at the predetermined inclination angle θ. Then, the multi-beam semiconductor laser 11 is fixed to the laser holder 11*a*. In mounting the multi-beam light source unit 1 in the optical box 8, the whole multi-beam light source unit 1 is only slightly inclined to compensate for the component precision and the like.

With this arrangement, the present invention exhibits the following effects.

The beam interval between a plurality of laser beams emitted by the multi-beam semiconductor laser can be adjusted within a short time with high precision. Accordingly, the apparatus can attain high resolution, the assembly cost can be greatly reduced, and the whole apparatus can be downsized.

Figure 11A:
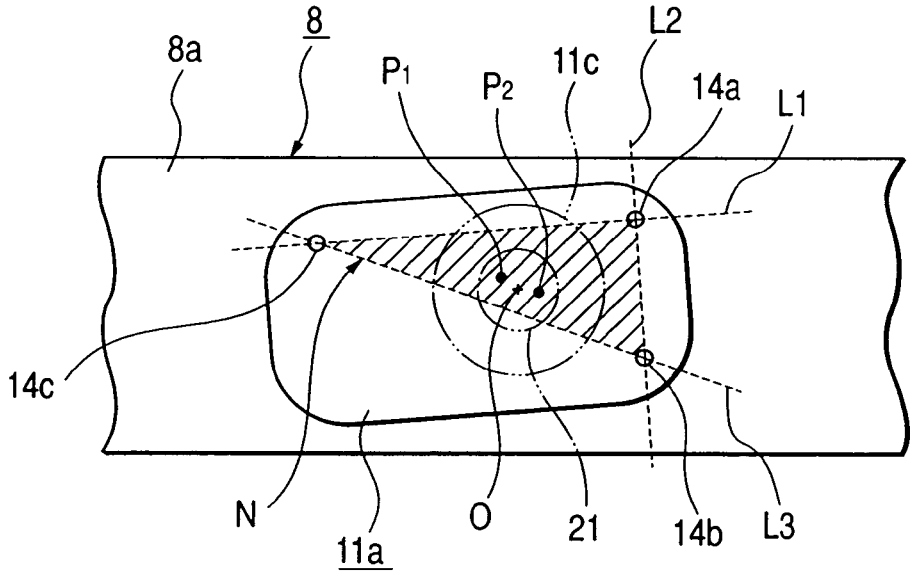
Figure 11B:
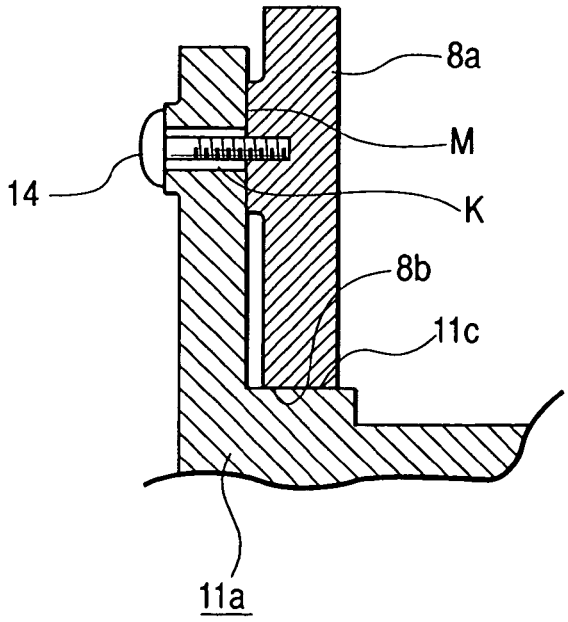

The fourth embodiment of the present invention will be described below. FIGS. 11A and 11B are schematic views showing the fourth embodiment of the multi-beam light source unit. The whole arrangement of the multi-beam scanning apparatus is the same as that shown in FIG. 3, and a description thereof will be omitted. The multi-beam light source unit will be explained.

As shown in FIGS. 11A and 11B, after a lens barrel 12*a* of a collimator lens 12 is adhered to a laser holder 11*a*, the laser holder 11*a* is temporarily fixed to a sidewall 8*a* of an optical box 8 with screws 14 (see FIGS. 11A and 11B) serving as fixing means fitted in holes in the laser holder 11*a*. While emitting laser beams $P_1$ and $P_2$, the laser holder 11*a* is rotated to adjust the inclination angle θ in order to adjust the line interval T, as shown in FIG. 5A.

This adjustment is to adjust the beam interval between the two laser beams $P_1$ and $P_2$ emitted by the multi-beam semiconductor laser 11, i.e., to make the pitch S between imaging points $A_1$ and $A_2$ on a rotary drum 5 in the main scanning direction, and a pitch, i.e., line interval T in the subscanning direction coincide with design values.

After the angular adjustment, the screws 14 are tightened to fix the laser holder 11*a* to the optical box 8.

In this adjustment, the laser holder 11*a* is rotated while the spot positions, i.e., imaging points $A_1$ and $A_2$ of the two laser beams $P_1$ and $P_2$ that displace in submicron order are monitored with a CCD camera or the like.

As shown in FIG. 11A, the three screws 14 fasten the laser holder 11*a* to the sidewall 8*a* of the optical box 8. Fixing portions 14*a* to 14*c* surround the emission points of the laser beams $P_1$ and $P_2$. That is, the three screws 14 are laid out to locate the emission points of the laser beams $P_1$ and $P_2$ on straight lines $L_1$ to $L_3$ connecting the fixing portions 14*a* to 14*c* or within a planar region N (shadow portion) defined by the straight line $L_1$ to $L_3$.

The laser holder 11*a* has a cylindrical boss 11*c*. As shown in FIG. 11B, the boss 11*c* is fitted in a cylindrical opening 8*b* in the sidewall 8*a* of the optical box 8 so as to rotate the laser holder 11*a*. The center O of rotation is also positioned on the straight lines $L_1$ to $L_3$ connecting the fixing portions 14*a* to 14*c* or within the planar region N defined by the straight lines $L_1$ to $L_3$.

With this layout, the emission points of the two laser beams $P_1$ and $P_2$ always fall within the range defined by lengths obtained by converting the intervals between the fixing portions 14*a* to 14*c* into main scanning and subscanning components. The wide range including the center O of rotation can be firmly fixed to effectively prevent vertical and horizontal tilt of the multi-beam light source unit 1.

Particularly, when the screws 14 are used as fixing means, the laser holder 11*a* and the sidewall 8*a* of the optical box 8 are pressed against each other via a fastening surface M. A clearance K is set as an adjustment margin for angular adjustment rotation. The laser holder 11*a* is moved within this range.

The fastening surface M at the fixing portions 14*a* to 14*c* of the screws 14 provides the highest fastening reliability and high stability because the laser holder 11*a* and sidewall 8*a* contact each other at fastening pressure generation positions. Note that if the fastening surface M does not completely coincide with the positions of the screws 14, the same effects can be obtained so long as they are close to each other. The position and shape of the fastening surface M and the number of fastening surfaces M need not be limited.

The fourth embodiment adopts the screws as fixing means, but may adopt an adhesion means with an ultraviolet-curing adhesive or the like. The number of emission points is not limited and may be arbitrarily set to two or more.

The collimator lens is adhered to the lens barrel preferably with the ultraviolet-curing adhesive, but may be adhered with another adhesive.

According to the fourth embodiment, the multi-beam light source unit is fastened to the sidewall of the optical box with screws at three or more fixing portions. The center of rotation of the multi-beam light source unit and the emission points of respective laser beams locate on straight lines connecting the fixing portions or within the planar region defined by straight lines connecting all the fixing portions. Thus, the multi-beam light source unit can be stably, firmly mounted in the optical box.

The fourth embodiment can realize a low-cost, high-performance multi-beam scanning apparatus capable of effectively avoiding troubles such as a rotational shift of the multi-beam light source unit upon high-precision line interval adjustment, and free running during fastening upon adjustment.

Figure 12:
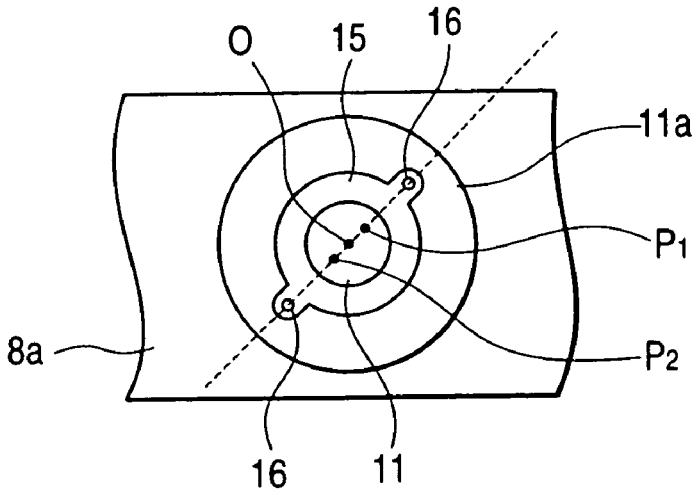
FIG. 12 is a schematic view showing the fifth embodiment of the multi-beam light source unit.

FIG. 12 shows the fifth embodiment of the multi-beam light source unit. When the position of the emission point of a multi-beam semiconductor laser 11 is greatly offset from the center O of rotation of a laser holder 11*a* due to low component precision, the multi-beam semiconductor laser 11 is adjusted again in the laser holder 11*a*. To realize this, an adjustment member 15 for adjusting the relative position is used and fastened to the laser holder 11*a* with screws 16.

The adjustment member 15 is relatively moved together with the multi-beam semiconductor laser 11 with respect to the laser holder 11*a* to adjust a laser array connecting laser beams $P_1$ and $P_2$ so as to pass through the center O of rotation. Then, the adjustment member 15 is fastened to the laser holder 11*a* with the screws 16.

Even if the positional precision of emission points varies in the component, the adjustment member 15 can adjust the positions of the emission points to locate them on straight lines $L_1$ to $L_3$ connecting fixing portions 14*a* to 14*c* or within the planar region N defined by all the straight lines $L_1$ to $L_3$, as shown in FIG. 11A.

The package shape of the multi-beam semiconductor laser can advantageously be selected from a wide range.

The edge-emission-type multi-beam semiconductor laser 11 on which a plurality of emission points are aligned may be replaced with a multi-beam semiconductor laser 41 having a surface-emission-type laser chip 42 on which a plurality of emission points 42*a* to 42*d* are two-dimensionally arrayed, as shown in FIG. 10. This multi-beam semiconductor laser 41 can advantageously reduce optical aberration because all the emission points can be made close to the optical axis of the collimator lens. A positioning hole 41*b* is formed in a disk-like laser holder 41*a* as a positioning reference used to adjust the inclination angle θ for adjusting line intervals $T_1$ to $T_3$.

The surface-emission-type laser can increase the degree of freedom for the positions of the emission points to facilitate distribution of the mounting tolerance.

As described above, in the multi-beam scanning apparatus of the present invention, the two laser beams $P_1$ and $P_2$ emitted by the multi-beam semiconductor laser are scanned by the rotary polygon mirror inside the optical box 8, and form an image on the photosensitive member on the rotary drum via the imaging lens. To adjust the line interval and the like on the photosensitive member, the laser holder 11*a* is fixed to the sidewall 8*a* of the optical box 8 after rotation through a predetermined angle. The fixing portions 14*a* to 14*c* are set to locate the emission points of the laser beams $P_1$ and $P_2$ and the center O of rotation on straight lines connecting the fixing portions 14*a* to 14*c* by the screws 14 or within the planar region N defined by these lines. The laser holder 11*a* is firmly, stably mounted with high positional precision.

With this arrangement, the present invention exhibits the following effects.

The line interval between a plurality of laser beams emitted by the multi-beam semiconductor laser can be adjusted with high precision, and the laser holder can be firmly, stably mounted.

The present invention can realize a low-cost, high-performance multi-beam scanning apparatus free from any multi-beam line interval error.

What is claimed is:

1. A multi-beam scanning apparatus comprising:

a light source unit comprising a laser light source, a holder holding said laser light source and a driving circuit board for driving said laser light source, said laser light source including a laser chip having a plurality of emission points for emitting laser beams and a terminal for energizing the laser chip, said driving circuit board being connected to the terminal of said laser light source;

scanning means for scanning a surface to be scanned with the laser beams emitted by said light source unit; and a housing having a wall, wherein said housing contains said scanning means and supports said light source unit on the wall, wherein said holder has a reference portion and said laser light source is fixed to said holder such that a hypothetical straight line connecting the plurality of emission points is inclined with respect to the reference portion so as to have an inclination angle equal to or close to a predetermined angle, and wherein said holder holding said laser light source is fixed to the wall of said housing after the inclination angle of the hypothetical straight line is finally adjusted by rotating said holder.

2. An apparatus according to claim 1, wherein said driving circuit board has a substantially rectangular shape.

3. An apparatus according to claim 1, wherein the plurality of emission points of said laser light source is arranged linearly.

4. An apparatus according to claim 1, wherein the plurality of emission points of said laser light source is arranged two-dimensionally.

5. An apparatus according to claim 1, wherein said light source unit further comprises a collimator lens for collimating the laser beams emitted from said laser light source and a lens barrel holding said collimator lens, said lens barrel being integrated with said holder.

6. An apparatus according to claim 1, wherein said laser light source is a multi-beam semiconductor laser.

7. An apparatus according to claim 1, wherein said scanning means comprises a rotary polygon mirror for deflecting the laser beams emitted by said light source unit and an imaging lens for focusing the laser beams deflected by said rotary polygon mirror.

* * * * *

UNITED STATES PATENT AND TRADEMARK OFFICE

CERTIFICATE OF CORRECTION

PATENT NO. : 6,992,690 B2
APPLICATION NO. : 09/392626
DATED : January 31, 2006
INVENTOR(S) : Shin Mogi et al.

It is certified that error appears in the above-identified patent and that said Letters Patent is hereby corrected as shown below:

Column 3:

Line 36, "semiconductor," should read --semiconductor laser,--.
Line 44, "the rotation" should read --rotation--.

Signed and Sealed this

Nineteenth Day of September, 2006

JON W. DUDAS
*Director of the United States Patent and Trademark Office*